United States Patent [19]

Iwai

[11] Patent Number: 4,961,660

[45] Date of Patent: Oct. 9, 1990

[54] METHOD FOR CORRECTING MISTYPES IN AN ELECTRIC TYPEWRITER

[75] Inventor: Hiroji Iwai, Nara, Japan

[73] Assignee: Sharp Kabushiki Kaisha, Osaka, Japan

[21] Appl. No.: 291,215

[22] Filed: Dec. 28, 1988

[30] Foreign Application Priority Data

Dec. 28, 1987 [JP] Japan ..... 62-334595

[51] Int. Cl.[5] ..... B41J 35/20

[52] U.S. Cl. ..... 400/697.1; 400/695

[58] Field of Search ..... 400/695, 696, 697, 697.1

[56] References Cited

U.S. PATENT DOCUMENTS

| | | | |
|---|---|---|---|
| 4,307,971 | 12/1981 | Kane, III et al. | 400/697 |
| 4,388,005 | 6/1983 | Wehking et al. | 400/697.1 X |
| 4,493,570 | 1/1985 | Araki | 400/322 |
| 4,692,045 | 9/1987 | Makita | 400/697 |
| 4,708,505 | 11/1987 | Tsumura et al. | 400/697.1 |
| 4,749,294 | 6/1988 | Barrus et al. | 400/322 |

FOREIGN PATENT DOCUMENTS

| | | | |
|---|---|---|---|
| 0160180 | 9/1983 | Japan | 400/697 |
| 0147376 | 8/1985 | Japan | 400/697 |
| 0198282 | 10/1985 | Japan | 400/697 |
| 0198283 | 10/1985 | Japan | 400/697 |
| 0280940 | 12/1986 | Japan | 400/697.1 |
| 0290566 | 12/1987 | Japan | 400/697.1 |

*Primary Examiner*—Edgar S. Burr
*Assistant Examiner*—John S. Hilten

[57] ABSTRACT

A method for correcting mistypes in an electric typewriter, wherein a printing type corresponding to a character to be corrected is struck a plurality of plural times onto a character, with a correction tape intervening between the printing type and the character, is disclosed. According to this method, a shifting operation of the correction tape is started after moving a carriage and the printing type to the position corresponding to the character. Then, when the shifting operation has been completed, the striking operation of the printing type is performed to correct the character.

5 Claims, 3 Drawing Sheets

PRIOR ART
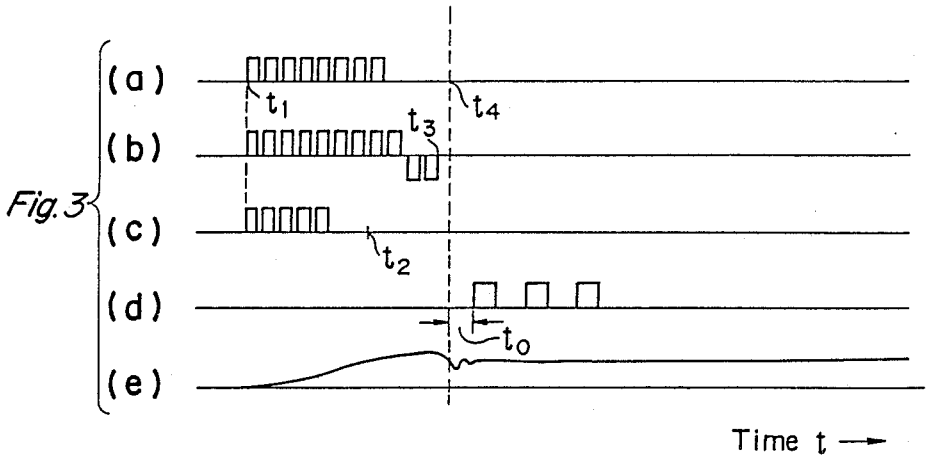
Fig.4
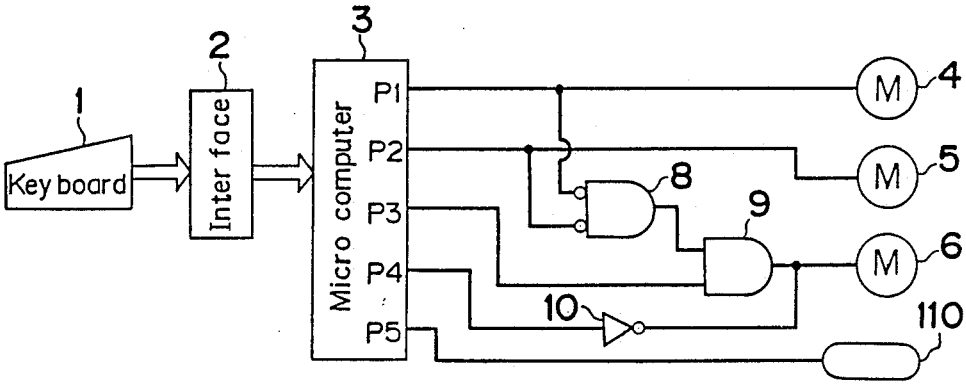

METHOD FOR CORRECTING MISTYPES IN AN ELECTRIC TYPEWRITER

BACKGROUND OF THE INVENTION

1. Field of the Invention

The present invention relates to an electric typewriter which is capable of making a correction with use of a correction tape, and more particularly, to a method for controlling the electric typewriter upon making such a correction.

2. Description of Prior Art

FIG. 1 is a perspective view of a conventional electric typewriter, FIG. 2 is a side view of the electric typewriter shown in FIG. 1.

In FIGS. 1 and 2, a printing paper 102 is set on a platen 101 which is rotated by a pulse motor (not shown). A carriage 103 is moved along a guide shaft 104 in the right and left directions by another pulse motor (not shown). A printing wheel 105 is rotatably supported by the carriage 103. The printing wheel 105 supports printing types 106 at respective free ends of flexible levers radially elongated from the center portion thereof. Upon printing a character on the printing paper 102, an ink ribbon 107 is arranged between the platen 101 and the printing type 106, and then, a hammer 109 is struck onto a printing type 106 positioned at the print position by an actuator 110, Thereafter the printing type 106 is struck onto the printing paper 102 together with the ink ribbon 107. However, upon making a correction, a correction tape 108 is set in place of the ink ribbon 107 so as to intervene between the printing wheel 105 and the platen 101, and then, the printing type 106 corresponding to a printed character to be erased is struck onto the intervening correction tape 108 a few times with use of the hammer 109 at the print position after positioning the printed character thereat.

In the aforementioned conventional electric typewriter, an operation of correction is controlled as shown in a timing chart of FIG. 3. In FIG. 3, (a) and (c) represent applied voltages to pulse motors for driving the carriage 103 and the printing wheel 105, respectively and (b) represents an applied voltage to a DC motor for shifting the ink ribbon 107 or the correction tape 108. Further, (d) represents pulses for driving the actuator 110 and (e) shows a vibration of the correction tape 108. As is apparent from FIG. 3, the movement of the carriage 103 to a position of the character to be corrected, the selection of the printing type 106 of the printing wheel 105 corresponding to the character to be corrected and the shifting operation of the correction tape 108 are all started at the same time $t_1$. A first ready signal representing the completion of the movement of the carriage 103 is outputted at a timing $t_4$. This occurs after a constant time interval from the stopping of a driving pulse to the pulse motor for the carriage 103. Then a second ready signal representing the completion of rotation of the printing wheel 105 is outputted at a time $t_2$ after a constant time interval from the stopping of the driving pulse to the pulse motor for the printing wheel 105. These time intervals are predetermined time intervals in which oscillations of the carriage 103 and the printing wheel 105 might be stopped. On the other hand, a third ready signal representing the completion of the shifting operation of the correction tape 108 is outputted at a time $t_3$, after the DC motor for driving the correction tape 108 has been braked. This is done by applying a negative voltage to the motor, as shown in (b) of FIG. 3. As shown in (d) of FIG. 3, three pulses for driving the hammer 109 are applied to the actuator 110 sequentially from the time $t_4$ or after a start time interval therefrom since the first to third ready signals have not been outputted until then. When the selected printing type 106 of the printing wheel 105 is struck onto the character to be corrected, three times, through the correction tape 108 by the hammer 109, the printed ink of the character is adhered onto the correction tape 108. Thus, the correction of the character is made.

The timings at which time, when the ready signals of the carriage 103 and the printing wheel 105 are respectively outputted are different from one another depending on the amounts of the movements of the carriage 103 and the rotation angle cf the printing wheel 105 etc. . .

Conventionally, a timer for counting a predetermined time interval $t_0$ is provided in order to avoid such a possibility that the printing type 106 would be struck while the oscillation of the correction tape 108 is still going on. The timer is started when all of the first to third ready signals have been outputted. Thus, the printing type is guaranteed to strike the character to be corrected after the oscillation of the correction tape 108 has stopped.

However, this method has such a disadvantage in that the ink adhered to the correction tape at the first stroke of the printing type is retransferred to the printing paper on the next stroke. This is because the position of the correction tape 108 struck at the next stroke is unchanged from that at the first stroke. This disadvantage is enhanced, especially in such an electric typewriter in that the correction position is automatically shifted from the former one, by a small distance, in order to avoid a possible miscorrection due to ar error in positioning the printing type over the character to be erased.

SUMMARY OF THE INVENTION

An object of the invention is to provide a method for correcting mistypes which can prevent the ribbon ink, adhered onto the correction, tape on the first correction from transferring again onto the printing paper on and after an second correction, in the electric typewriter which makes a correction by striking a hammer a plural number of times without feeding the correction tape.

According to one aspect of the present invention, a method is provided for correcting mistypes in an electric typewriter comprising steps of: moving a carriage over a position of a printed character which is to be erased; rotating a printing wheel so as to position a printing type at the position of the printed character which is to be erased; outputting first and second ready signals representing the completions of the moving step and: rotating step, respectively; shifting a correction tape so that a fresh portion thereof is positioned in front of the position of the printed character which is to be erased, after said first and second ready signals have been outputted; outputting a third ready signal when the shifting operation of the correction tape has been completed; and striking the printing type of the printing wheel a plural number of times, onto the printed character on a printing paper accompanying the correction tape, by the hammer when the third signal has been outputted.

In the aforementioned electric typewriter according to the present invention, since the shifting operation of the correction tape is performed after the first and second ready signals are outputted, respectively representing the completion of the moving operation of the carriage and the completion of the rotating operation of the printing wheel, and the third ready signal is outputted representing the completion of the shifting operation of the correction tape, the time interval between the third ready signal and the first strike of the hammer is constant This results in that the first strike of the hammer is performed when said oscillating correction tape is positioned at a predetermined height. Then, the second and subsequent strikes of the hammer are performed when the correction tape is positioned at a prearranged height in a static condition. Therefore, since the position of the correction tape to the struck printing type at the previously first stroke, is different from the position of the correction tape at the second and subsequent strikes, the ratio of transferring the ribbon ink adhered to the correction tape again, at the first correction onto the printing paper, is reduced as compared with the conventional example. This results in that an extremely high quality of the correction being obtained. Particularly, an extremely remarkable effect can be obtained when the present invention is applied to an electric typewriter where the second and subsequent operations of correction are performed after the carriage is moved slightly in the left and right directions.

BRIEF DESCRIPTION OF THE DRAWINGS

The present invention may be better understood and its numerous objects and advantages will become apparent to those skilled in the art by reference to the accompanying drawings as follows:

FIG. 3 is a timing chart showing the operation of the electric typewriter shown in FIG. 1;

FIG. 4 is a schematic diagram of an electric typewriter comprising a method for making a correction of the preferred embodiment according to the present invention;

DETAILED DESCRIPTION OF THE PREFERRED EMBODIMENT

The preferred embodiment according to the present invention will be described hereinafter, referring to the attached drawings.

Figure 2:
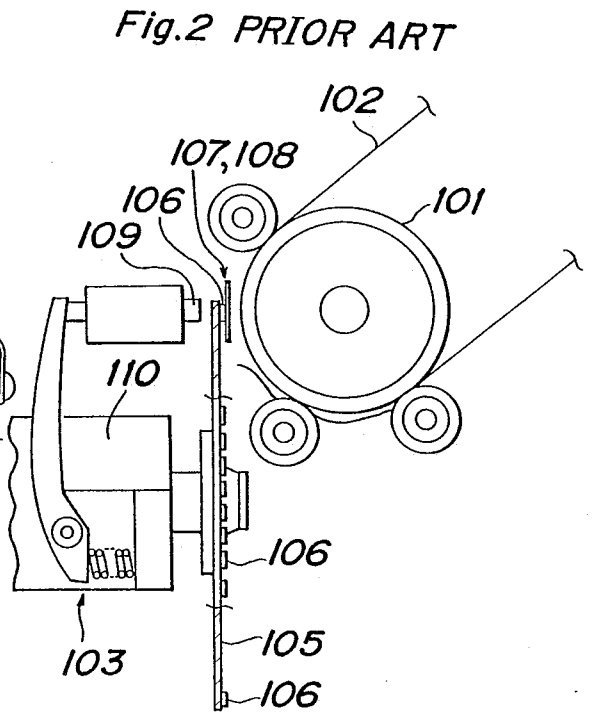
Fig.2 PRIOR ART
FIG. 2 is a side view of the electric typewriter shown in FIG. 1.
Figure 1:
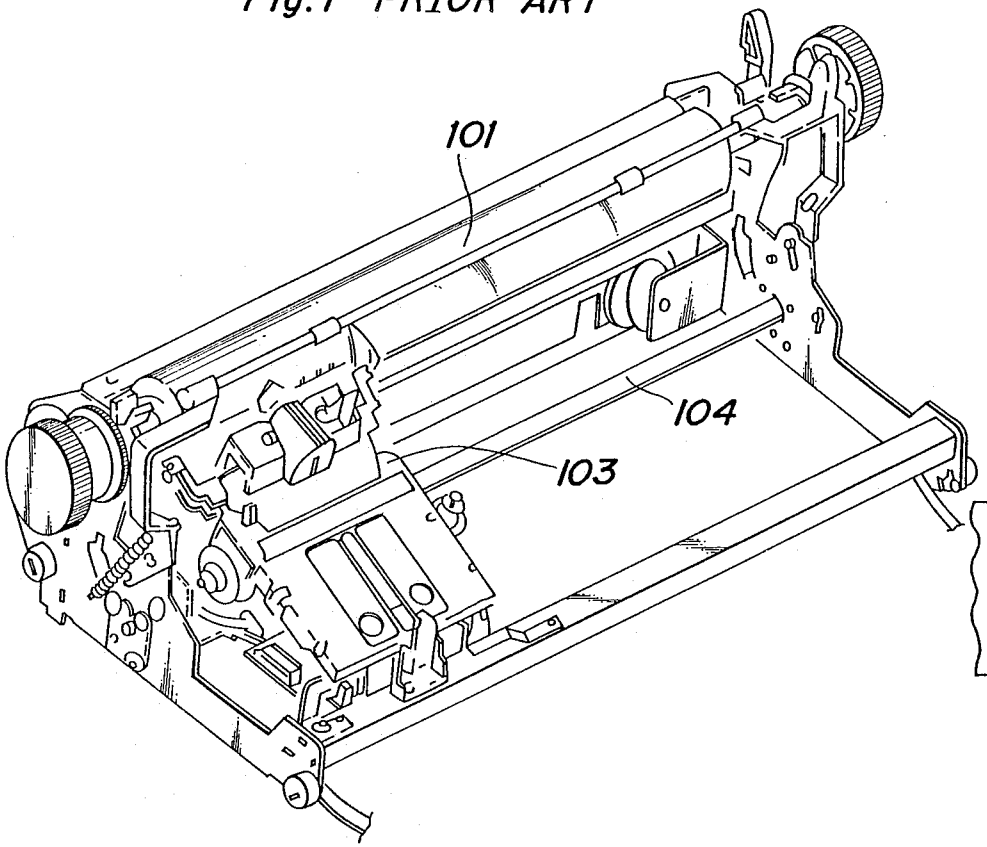
Fig.1 PRIOR ART
FIG. 1 is a perspective view of a conventional electric typewriter.

FIG. 4 is a schematic diagram of an electric typewriter comprising a method for making a correction in a preferred embodiment according to the present invention. The system of the electric typewriter comprising components 101 to 110 is constructed similar to the system of the conventional electric typewriter shown in FIGS. 1 and 2. In FIG. 4, a microcomputer 3 processes a key input signal which is input from a keyboard 1 through an interface circuit 2 in accordance with a predetermined program so as to control the overall operation of the electric typewriter. First to third output ports P1–P3 of the microcomputer 3 are used for outputting driving signals for a motor 4 for driving a carriage 103, a motor 5 for driving a printing wheel 105, and a motor 6 for shifting an ink ribbon 107 and a correction tape 108, respectively. A fourth output port P4 is used for outputting a braking signal for the motor 6 for shifting the tapes 107 and 108 and a fifth output port P5 is used for outputting a driving signal for an actuator 110. The first output port P1 and the second output port P2 are connected with input terminals of a NAND gate 8, an output terminal of the NAND gate 8 and the third output port P3 are connected with input terminals of an AND gate 9 and an output terminal of the AND gate 9 is connected with the motor 6 for shifting the tapes 107 and 108. Therefore, the motor 6 for shifting the tapes is not driven as long as either of the driving signals for the motor 4 for driving the carriage 103 or the motor 5 for driving the printing wheel 105 as respectively outputted from the first and second output ports P1 and P2. The braking signal outputted from the fourth output port P4 is inverted by an inverter. The inverted braking signal is supplied into the motor 6 for shifting the tapes at a negative voltage.

Figure 5:
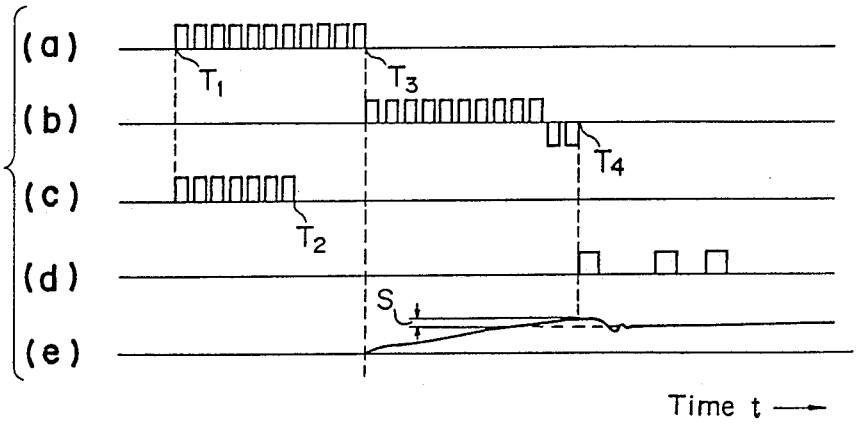
FIG. 5 is a timing chart showing the operation of the electric typewriter shown in FIG. 4.
Figure 6:
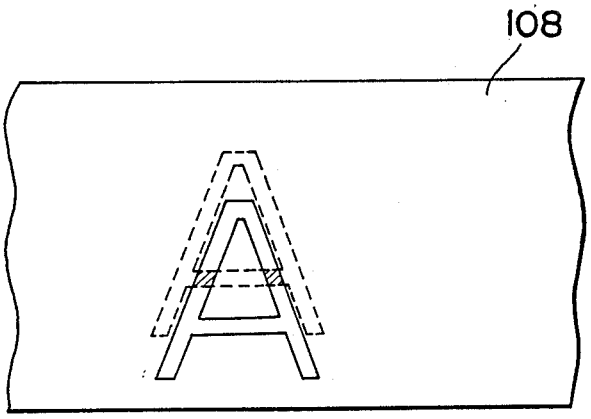
FIG. 6 is a front view of a correction tape showing a relationship between the correction tape and a printing type controlled in accordance with the timing shown in FIG. 5.

In the electric typewriter constructed as described above, the correction is controlled as shown in a timing chart of FIG. 5. In FIG. 5, (a) to (e) represent the voltage applied into the motor 4 for driving the carriage 103, the voltage applied into the motor 6 for shifting the tapes, the voltage applied into the motor 5 for driving the printing wheel 105, the driving supplied voltage into the actuator 110 and the position of the height of the correction tape 108, respectively, as well as (a) to (e) of FIG. 3. At a timing $T_1$, as shown in (a) and (c) of FIG. 5, the motor 4 for driving the carriage 103 and the motor 5 for driving the printing wheel 105 are driven at the same time. Further, the movement of the carriage 103 to the printed character on the printing paper 102 and the selection of the printing type 106 of the printing wheel 105 are performed at the same time. Then, the ready signal of the printing wheel 105 is outputted at a timing $T_2$ shown in FIG. 5 and the ready signal of the carriage 103 is outputted at a timing $T_3$. This results in that the output signal of the NAND 8 being of a high level and the driving signal is supplied to the motor 6 for shifting the tapes as shown in (b) of FIG. 5. Then, the shifting operation of the correction tape 108 starts. The motor 6 for shifting the tapes is then braked, and at a timing $T_4$, the ready signal of the correction tape 108 is outputted and the first strike of the hammer 109 is performed simultaneously as shown in (d) of FIG. 5. At that time, the output timing of the ready signal of the correction tape 108 is always coincident with the timing of the first strike of the hammer 109 independent of the output timing of the ready signal of the carriage 103 or the printing wheel 105. Therefore, at that time, the-shift amount S from the position of the prearranged height of the oscillating correction tape 108 always becomes a constant, and the first strike of the hammer 109 is performed when the correction tape 108 is positioned at the highest position as shown in (e) of FIG. 5. Therefore, as shown in FIG. 6, the printing type 106 of "A" is struck onto the slightly lower position from the prearranged position of the correction tape 108, and the ribbon ink is adhered onto the printed character of "A" as shown in the continuous line of FIG. 6. This results in that a larger portion of the printed character "A", on the printing paper 102, being erased.

Next, the second strike of the hammer 109 is performed after a constant time passes from the first stroke of the hammer 109, since the oscillation of the correction tape 108 stops and the correction tape 108 is positioned at the prearranged height in a static condition as is apparent from (d) and (e) of FIG. 5. At that time, the printing type 106 is struck at the prearranged position of the correction tape 108 as shown in the broken line of FIG. 6. Therefore, during the second and third stroke of the hammer 109, the ribbon ink adhered to the correction tape 108 which can be transferred again or to the printing paper 102, is only the portion shown in the oblique line portion of FIG. 6. Since the unused portion of the correction tape 108 is struck onto the printing paper 102 by the printing type 106, the portion other than the oblique line portion of FIG. 6 can not be transferred onto the printing paper 102 again. The ratio of the ribbon ink which can be transferred onto the printing paper 102 again is different dependent on the printed character to be erased. Further, the ratio of the ribbon ink which can be transferred again onto the printing paper 102 again is remarkably smaller than the ratio in the conventional method for controlling the correction. The speed of the correction is slightly reduced as compared with the speed of the correction in the conventional example. However, there is no problem since the speed of the correction is different from the speed of printing.

The present invention is not limited to the aforementioned description and one example in the attached drawings, and the present invention can include various kinds of modifications without departing from the spirit and scope of the claims. For example, the timer circuit may be driven to be started in accordance with the output of the ready signal of the correction tape 108, and the first stroke may be driven after a timer time passes.

It is understood that various other modifications will be apparent to and can be readily made by those skilled in the art without departing from the scope and spirit of the present invention. Accordingly, it is not intended that the scope of the claims appended hereto be limited to the description as set forth herein, but rather that the claims be construed as encompassing all the features of patentable novelty that reside in the present invention, including all features that would be treated as equivalents thereof by those skilled in the art to which the present invention pertains.

What is claimed is:

1. A method for correcting mistypes by an electric typewriter comprising steps of:

moving a carriage to a position corresponding to a printed character to be erased;

rotating a printing wheel so as to position a printing type, corresponding to said printer character to be erased, at said carriage position;

outputting first and second ready signals upon completion of said moving step and rotating step, respectively;

shifting a correction tape so as to position an unused portion thereof to a position in front of the printed character to be erased in response to said outputted first and second ready signals;

outputting a third ready signal subsequent to said shifting step, said output of said third ready signal corresponding to said correction tape oscillating and reaching a predetermined maximum height; and striking said printing type of said printing wheel, with a hammer, a plurality of times such that said correction tape strikes said character to be erased, said hammer initially striking said printing type in response to the third signal being outputted when said correction tape is at its predetermined maximum height and said hammer subsequently striking said printing type a predetermined time period after said third ready signal when said correction tape has stopped oscillating and is in a static state lower than said predetermined maximum height and positioned directly over said printed character.

2. The method for correcting mistypes in an electric typewriter as defined in claim 1, wherein said plural striking steps comprise a second time and a third time and are performed after a first and a second predetermined time period.

3. A method, as claimed in claim 1, further comprising the step of:

braking said correction tape, after said step of shifting said correction tape, thereby causing said correction tape to oscillate, and outputting said third ready signal upon completion of said braking step when said oscillating correction tape reaches said predetermined maximum height.

4. An apparatus for correcting mistypes by an electronic typewriter, comprising:

first motor means for moving a carriage to a position corresponding to a printer character to be erased;

second motor means for rotating a printing wheel so as to position a printing type, corresponding to said printed character to be erased, at said carriage position;

control means, connected to said first and second motor means, for outputting first and second ready signals upon completion of said first motor moving and said second motor rotating, respectively;

third motor means, responsive to said outputted first and second ready signals, for shifting a correction tape so as to position an unused position in front of said printed character to be erased;

said control means outputting a third ready signal subsequent to said shifting by said third motor means, said output of said third ready signal corresponding to said correction tape oscillating and reaching a predetermining maximum height;

hammer means, responsive to said outputted third ready signal, for striking said printing type a first time when said correction tape is oscillating and has reached its predetermined maximum height, and said hammer means being further responsive to said third ready signal for subsequently striking said printing type, a predetermined time period after said third ready signal, when said correction tape has stopped oscillating and is in a static state lower than said predetermined maximum height and positioned directly over said printed character to thereby erase said printed character.

5. An apparatus, as claimed in claim 4, wherein said control means sends a signal to brake said correction tape to said third motor means, prior to outputting said third ready signal, thereby causing said correction tape to oscillate; and said control means outputting said third ready signal upon completion of said braking by said third motor means, when said correction tape reaches said predetermined maximum height.

* * * * *